US006045330A

United States Patent [19]

Williams

[11] Patent Number: 6,045,330

[45] Date of Patent: Apr. 4, 2000

[54] RETROFITABLE FAN SHROUD

[76] Inventor: Robert E. Williams, 3820 Wingate, Columbus, Ga. 31909

[21] Appl. No.: 08/845,604

[22] Filed: Apr. 25, 1997

[51] Int. Cl.[7] ..... F04B 39/10

[52] U.S. Cl. ..... 416/247 R; 415/121.2

[58] Field of Search ..... 416/247 R, 247 A; 415/121.2

[56] References Cited

U.S. PATENT DOCUMENTS

| | | | |
|---|---|---|---|
| 2,325,913 | 8/1943 | McLemore, Jr. | 416/247 |
| 2,362,323 | 11/1944 | Stoppel | 415/121.2 |
| 4,018,270 | 4/1977 | Kolinger et al. | 165/119 |
| 4,018,297 | 4/1977 | Haupt | 180/54 |
| 4,100,965 | 7/1978 | Kolinger et al. | 165/119 |
| 4,335,646 | 6/1982 | Jacquet et al. | 416/247 R |
| 4,487,551 | 12/1984 | Mizitani et al. | 416/135 |
| 4,634,346 | 1/1987 | Cameron et al. | 416/247 A |
| 4,774,911 | 10/1988 | Yamaguchi | 123/41.49 |
| 5,129,473 | 7/1992 | Boyer | 180/68.1 |
| 5,216,983 | 6/1993 | Nilson | 123/41.12 |
| 5,219,016 | 6/1993 | Bolton et al. | 165/41 |
| 5,427,502 | 6/1995 | Hudson | 415/211.1 |
| 5,474,121 | 12/1995 | Bryson | 165/41 |

FOREIGN PATENT DOCUMENTS

| | | | |
|---|---|---|---|
| 62-0288390 | 12/1987 | Japan | 416/247 R |

*Primary Examiner*—F. Daniel Lopez
*Assistant Examiner*—Richard Woo

[57] ABSTRACT

A fan shroud retrofittable about a vehicle's fan and mountable to the fan housing, to prevent access thereto by animals. A first embodiment includes a pair of semi-circular screened housing members which include a pair of aligned, planar flange members. When the respective pairs are joined to the companion pairs of a second housing member, the assembly defines a circular shroud for mounting to the fan housing. A second embodiment for the shroud of this invention consists of a unitary, circular housing having a radially extending opening to override the shaft of the fan.

1 Claim, 3 Drawing Sheets

RETROFITABLE FAN SHROUD

1. Field of the Invention

The present invention relates to pet protection devices. More particularly, the present invention relates to a fan guard for vehicles to prevent animals from perching in the fan shroud.

BACKGROUND OF THE INVENTION

Vehicle efficiency is improved by adding a shroud around the cooling fan. Unfortunately, the shroud provides a convenient resting place for animals, especially in cold weather when the vehicle is warm. Animals perch in the shroud to keep warm. When the vehicle is started considerable damage can be done to both the vehicle and the animal as the animal spins around within the shroud as the vehicle runs. This often kills the animal.

Numerous innovations for a fan shroud guard have been provided in the prior art that are described as follows. Even though these innovations may be suitable for the specific individual purposes to which they address, they differ from the present invention as hereinafter contrasted.

In U.S. Pat. No. 5,474,121, titled Fan Shroud with Locating Claw, invented by Bruce A. Bryson, Erin Faessler and Robert Gmerek, there is disclosed a fan motor support, for use in combination with a motor vehicle radiator of the type having a U-shaped channel extending along an upper side of the radiator, having a motor mounting portion, a support structure and a claw portion. The motor mounting portion has a motor opening therethrough. The support structure is configured to extend across a portion of a rear surface of the radiator. The claw portion extends from the support structure and has a first member configured to reside in the U-shaped channel.

In U.S. Pat. No. 5,427,502, titled Fan Shroud Aspirator, invented by Scott A. Hudson, there is taught an aspirator mounted on a fan shroud surrounding a vehicle cooling fan. The aspirator has a housing which forms a duct which connects an opening to a port for connecting to a vehicle function. The aspirator is spaced apart from the fan and upstream from the fan and extends at an acute angle with respect to a tangent to a cylindrical wall of the shroud. The aspirator has a near edge which faces generally opposite to a direction of rotation of the fan blades and which is parallel to a leading edge of a fan blade when the leading edge is spaced apart from the near edge by a distance which is slightly larger than the width of the fan blade. The aspirator has a flange which projects parallel to a plane of rotation of the fan and generally in the rotation direction of the fan. The duct has a triangular cross sectional shape with an apex which projects in a direction which is upstream with respect to the flow of air moved by the fan.

In U.S. Pat. No. 5,219,016, titled Radiator, Condenser and Fan Shroud Assembly, invented by James D. Bolton, Li-Jen P. Ho and Michael E. Rutt, a fan shroud, radiator and condenser assembly for an air conditioned vehicle is disclosed, whereby a limited number of fasteners are utilized so as to provide a more efficient and maintenance free assembly. The components of the assembly are connected through a slidable connecting means, and a pre-stressed mounting panel is utilized to secure and maintain the components in their assembled positions.

In U.S. Pat. No. 5,216,983, titled Vehicle Hydraulic Cooling Fan System, invented by Carl A. Nilson, there is disclosed a hydraulic cooling system for vehicles utilizing a hydraulic pump driven by the vehicle engine, the pump, preferably, having high and low volume chambers, a shroud adapted to be associated with the vehicle engine cooling radiator, a fan driven by hydraulic fluid pressurized by the pump for producing air flow through the shroud and the engine cooling radiator, and the hydraulic circuit between the pump and the fan motor includes a reservoir and a control valve sensitive to the engine coolant temperature. The control valve is located within the reservoir, and the reservoir is mounted upon the shroud and includes heat exchanging fins exposed to the air passage within the shroud. The entire combination of components may be pre-assembled and shipped and installed as a unit.

In U.S. Pat. No. 5,129,473, titled Fan/Radiator Combination for Snowmobile with Liquid Cooled Engine, invented by Kirk A. Boyer, an improved liquid cooled heat management system for a snowmobile vehicle is described. To maintain the under-the-hood air temperature at optimum operating values while providing the necessary cooling for the vehicle's internal combustion engine, an air inlet opening is formed in the hood or other body panel of the snowmobile defining the engine compartment and disposed within this engine compartment is an appropriately sized heat exchanger through which the liquid coolant is made to flow when the engine is running. The air inlet opening in the hood or body panel designed to enclose the heat exchanger or radiator on the fan suction side and an engine-driven fan also disposed within the duct draws outside air through the heat exchanger at a rate that is directly related to engine speed. Because of the manner in which the duct work is structured, warmer, under-the-hood air is effectively isolated from the stream of cold outside air drawn through the heat exchanger. Furthermore, the engine's exhaust manifold is also liquid-cooled which further enhances the overall efficiency of the system.

In U.S. Pat. No. 4,774,911, titled Cooling Fan Shroud Mounted on an Engine Vehicle, invented by Yutaka Yamaguchi, Tatsuya Yamaguchi and Hisao Nagata, a cooling fan shroud is shown mounted on an engine vehicle compriseing an engine mounting, a radiator mounting and a flexible member made of rubber bellows and connecting the engine mounting and the radiator mounting. The lower portion of the engine mounting formed in a reverse U-shape, and includes a proportion of the radiator mounting is formed in a reverse L-shape. The radiator has a support projecting from the lower portion thereof and formed in a U-shape cross section. The reverse L-shaped lower portion of the radiator mounting of the fan shroud is inserted into the U-shaped support projecting from the lower portion of the radiator. The engine has a support formed in a L-shape at the lower portion thereof. The reverse U-shaped lower portion of the engine mounting is inserted onto the L-shaped support of the engine. The upper portions of the engine mounting and radiator mounting of the fan shroud are secured to the engine and the radiator by means of screws.

In U.S. Pat. No. 4,487,551, titled Fan Assembly for Vehicles, invented by Keri-Ichiro Mizutani, Hiroto Masai and Nobuyoshi I(ozawa, a cooling fan assembly made of plastic material and composed of a plurality of fan blades is a boss and connected to a viscous fluid coupling device rotatably mounted through a bearing assembly on a driving shaft of an automotive vehicle. An axially resilient connecting member in the form of a plate spring is fixed to the boss of the fan assembly at one end thereof and to the coupling device at the other end thereof, whereby the inertia moment of the fan rotation causes the appropriate rotation of the fan assembly in spite of possible misalignment of the coupling device with respect to the driving shaft to thereby protect the bearing assembly from being damaged. Helical or waved springs may be interposed between the fan boss and the coupling device in place of the plate spring.

In U.S. Pat. No. 4,018,270, titled Automotive fan Shroud for Screening Debris, invented by Kenneth J. Kolinger, Norman E. Williams, Donald M. Earley and William R. Golden, there is disclosed a shroud, associated with a type of automotive fan and a vehicle radiator core, supports in a position between the fan and core an interposed debris screen which is slidable in guides in the shroud so as to be readily removable transversely out of the hood of an automotive vehicle for cleaning of the screen. Doing the job of cleaning a removed screen is more simplified as a task than, cleaning debris from a radiator core in situ.

In U.S. Pat. No. 4,018,297, titled Four-Piece Fan Shroud, invented by Robert C. Haupt, a multi-piece fan shroud is disclosed having a front mounting flange adapted for fastening to a radiator of a motor vehicle and rear venturi portion for discharge of air to improve the efficiency and quietness of operation of the fan and shroud.

In U.S. Pat. No. 4,100,965, titled Automotive Fan Shroud for Screening Debris, there is disclosed a shroud, associated with a type of automotive fan and a vehicle radiator core, supports in a position between the fan and core an interposed debris screen which is slidable in guides in the shroud so as to be readily removable transversely out of the hood of an automotive vehicle for cleaning of the screen. Air enters the fan shroud under pressure by being blown in through fan opening means defined by the shroud at one end, and exits under pressure in a path through a radiator attachment means carried by the shroud at the other, or discharge, end. Intermediate the ends of the shroud, the debris screen is interposed with its plane between the respective planes of the opening means and attachment means, so as to screen all air being forced under pressure in the path therethrough.

The above patented inventions differ from the present invention because they fail to describe or claim at least one combination of the following features depicted in the present invention: a pet safety guard which surrounds the moving parts of a fan functioning to keep pets away. Further the present invention can be installed on a vehicle after the point of manufacture. The present invention adapts to ducted fans which are enclosed within an aerodynamic shroud and fans which are unshrouded.

SUMMARY OF THE INVENTION

Owners of small out of doors animals are concerned that the animal will perch in the fan shroud of their vehicle and be injured when the vehicle is started. While the pet owner can take some precautions such as making loud noises often the animal is too comfortable next to a warm radiator to move. Though opening the hood to check on an animal would be effective, it is very inconvenient to the vehicle driver and is impossible if the vehicle does not belong to the pet owner.

The types of problems encountered in the prior art are that animals can perch in the space near the radius and within the diameter of the fan blades. When the vehicle is started the animal can be severely injured or killed.

In the prior art, unsucessful attempts to solve this problem were attempted namely: tangential device which mainly increased cooling efficiency and were not directed to the problem of protecting animals. Further, the prior art is installed at the time of manufacture of the vehicle. However, the problem was solved by the present invention because a barrier is installed between the animal and the fan blades. The present invention may be installed after the vehicle is produced.

The present invention went contrary to the teaching of the art by providing a guard which surrounds the moving parts of the fan functioning as a barrier to animals.

The present invention solved a long felt need for a device which would prevent a pet from entanglement in the blades of a vehicle cooling fan.

Accordingly, it is an object of the present invention to provide a pet barrier which is retrofitable to existing vehicles having a shrouded fan or a non-shrouded fan.

More particularly, it is an object of the present invention to provide a first retrofitable fan shroud having two halves which are securely fastened together at a central seam and securely fasten to a vehicle fan shroud.

In keeping with these objects, and with others which will become apparent hereinafter, one feature of the present invention resides, briefly stated, in a first left guard and a first right guard which provide a barrier behind the fan blades and attaches to the fan housing.

When the first retrofitable fan shroud is designed in accordance with the present invention, an effective pet protection barrier is provided.

In accordance with another feature of the present invention, a fastening means having a first left guard side fastening member and a first right guard side fastening member join the two halves of the first retrofitable fan shroud at a central seam.

Another feature of the present invention is that a guard side fastening member functions to secure the first retrofitable fan shroud at an outer diameter to the fan housing.

Yet another feature of the present invention is that the first retrofitable fan shroud permits uninterrupted flow of air therethrough Still another feature of the present invention is that installation can be accomplished after the vehicle is manufactured.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

DESCRIPTION OF THE PREFERRED EMBODIMENT

Figure 1:
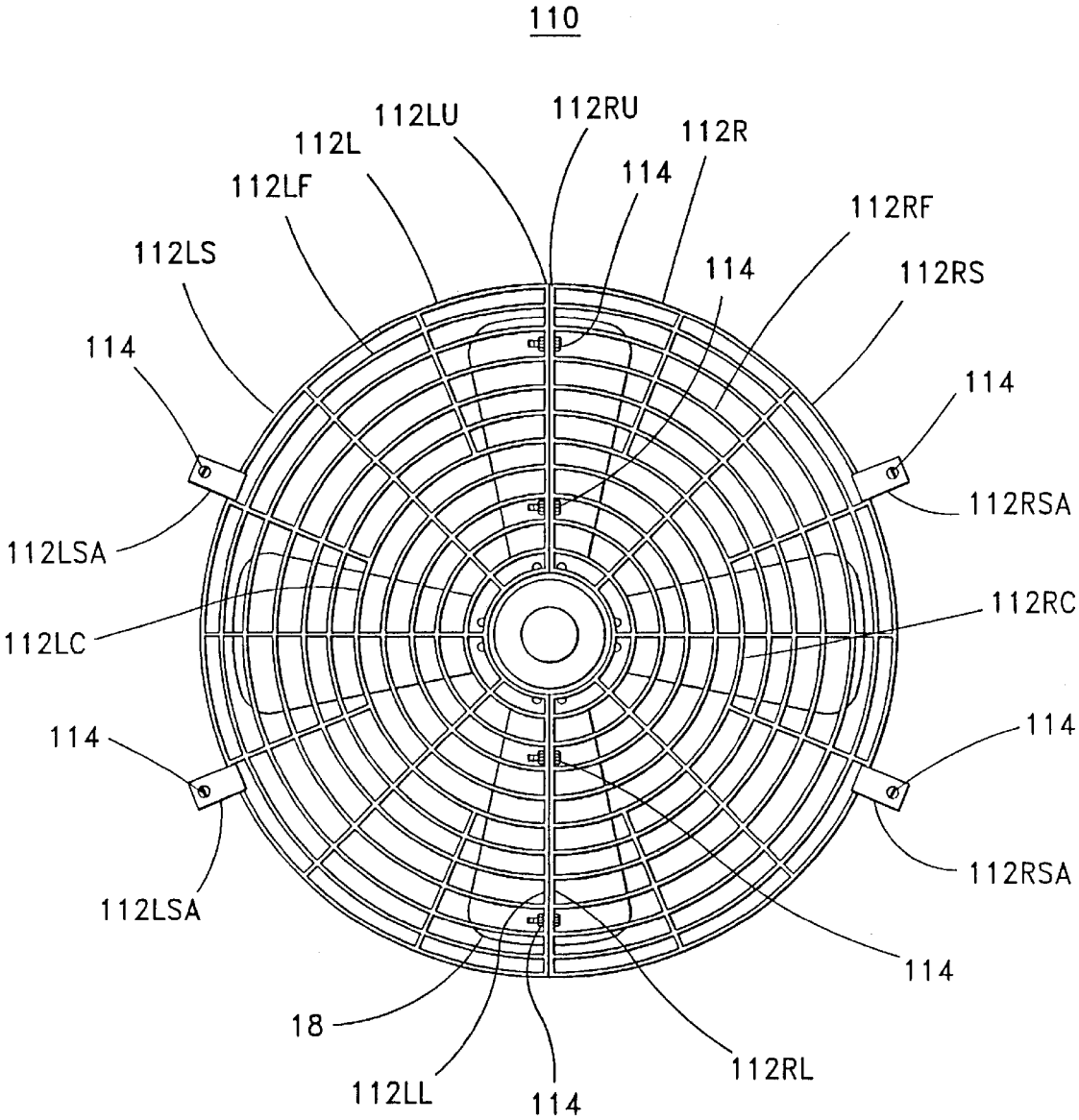
FIG. 1 is a front view of a first embodiment for a retrofittable fan shroud mounted on a fan housing containing a fan therein in accordance with the present invention.
Figure 2:
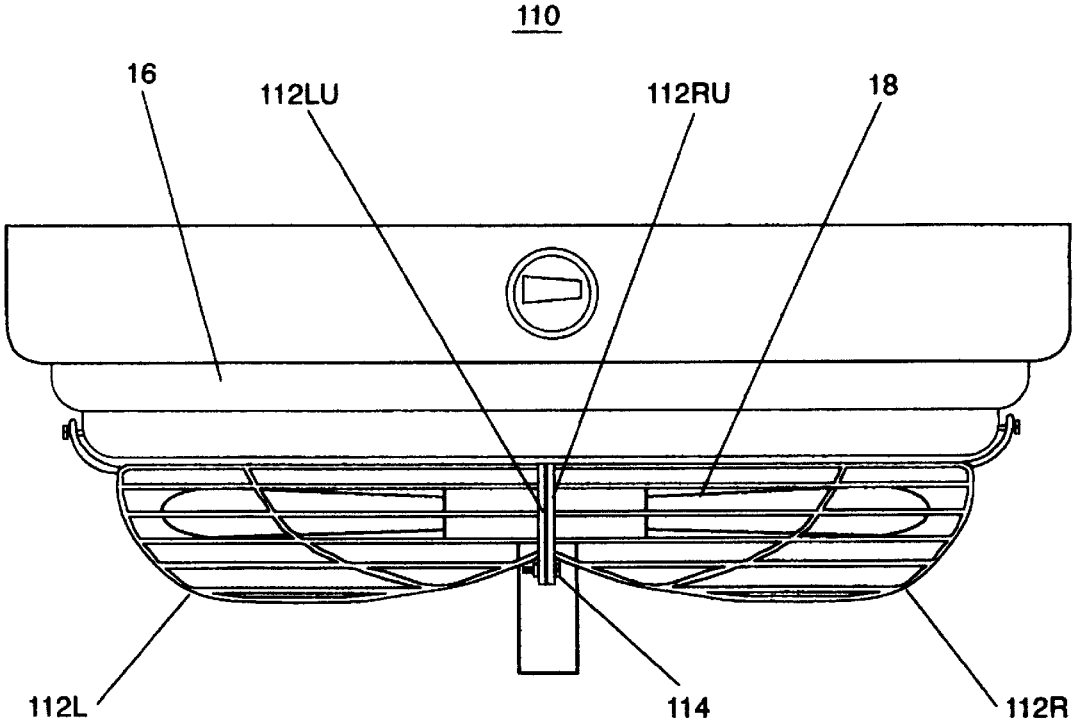
FIG. 2 is a top view of the front embodiment for the retrofittable fan shroud mounted on a fan housing shown in FIG. 1.

Turning now to the several FIGURES, there is shown in FIG. 1 and FIG. 2, respectively a front view and top view of a first retrofitable fan shroud (110) mounted on a fan housing (16) containing a fan (18) therein, respectively. The first retrofitable fan shroud (110) comprises a first left guard (112L) which comprises a first left guard front (112LF) and a first left guard side (112LS) terminating at a top end at a first left guard upper (112LU) and terminating at a bottom end at a first left guard lower (112LL). The first left guard side (112LS) further comprises at least one first left guard side fastening member (112LSA) securely attached thereto.

The first retrofitable fan shroud (110) further comprises a first right guard (112R) which comprises a first right guard front (112RF) and a first right guard side (112RS) terminating at a top end at a first right guard upper (112RU) and terminating at a bottom end at a first right guard lower (112RL). The first right guard side (112RS) further comprises at least one first right guard side fastening member (112RSA) securely attached thereto. The first left guard front (112LF), the first left guard side (112LS), the first right guard front (112RF), and the first right guard side (112RS) are manufactured from a configuration selected from a group consisting of grid, screen and perforated.

The first retrofitable fan shroud (110) may optionally further comprise a first left guard center (112LC) and a first right guard center (112RC) positioned centrally in the first left guard (112L) and first right guard (112R), respectively. The first left guard center (112LC) and the first right guard center (112RC) function to permit user access to the fan (18).

The first retrofitable fan shroud (110) further comprises at least one first fastener (114) connecting the first left guard upper (112LU) to the first right guard upper (112RU). At least one first fastener (114) connects the first left guard lower (112LL) to the first right guard lower (112RL). At least one first fastener (114) connects the at least one first left guard side fastening member (112LSA) to a left side of the fan housing (16) and at least one first fastener (114) connects the at least one first right guard side fastening member (112RSA) to a right side of the fan housing (16).

The first retrofitable fan shroud (110) is constructed from a material selected from a group consisting of plastic, plastic composite, metal, metal alloy, fiberglass, epoxy, carbon-graphite, and wood.

Figure 3:
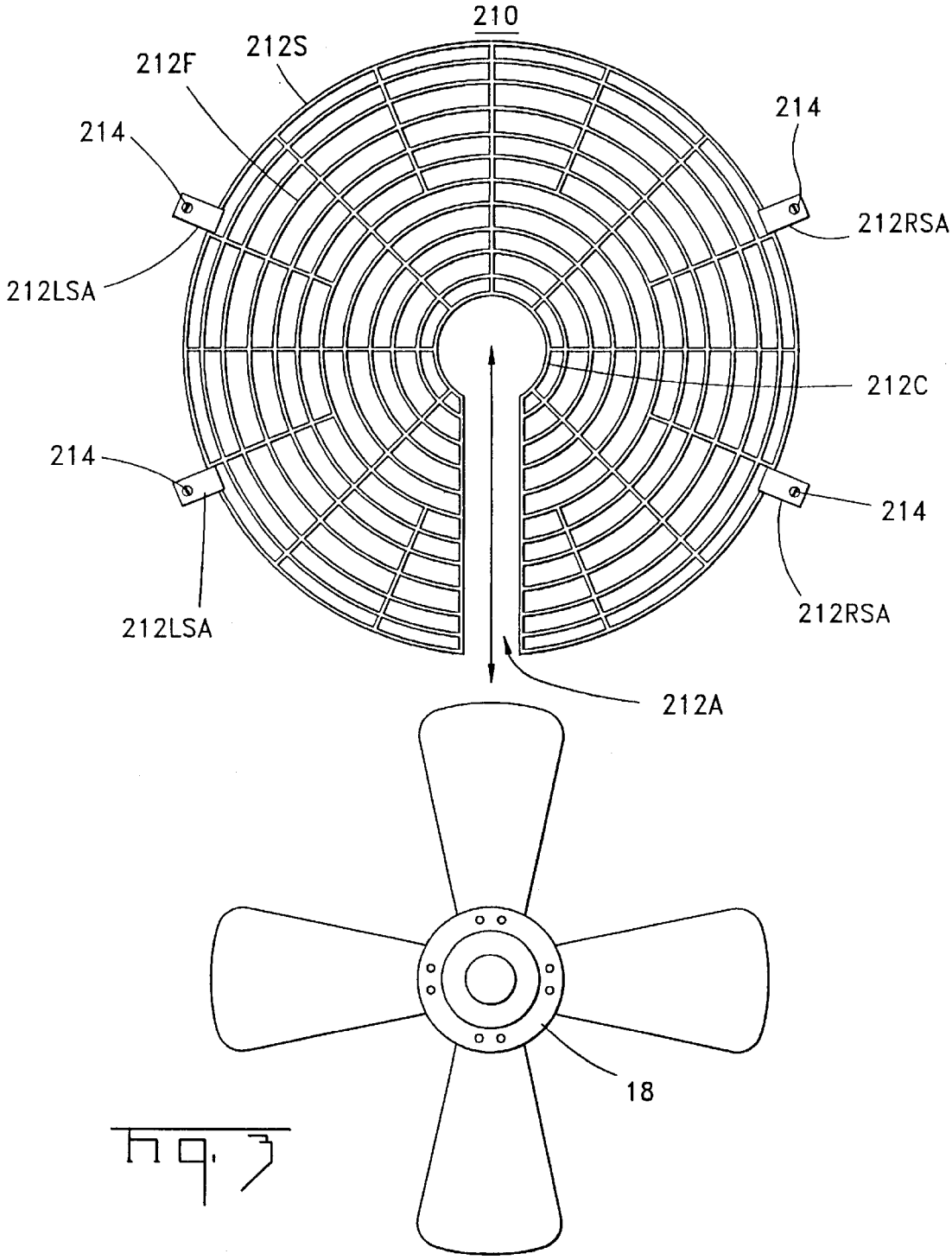
FIG. 3 is an exploded front view of a second embodiment retrofittable fan shroud of this invention, showing the shroud positioned for mounting on a fan housing.

Referring now to FIG. 3 which is an expanded front view of a second embodiment for a retrofitable fan shroud (210) mounted on a fan housing (16) containing a fan (18) therein, respectively. The second retrofitable fan shroud (210) comprises a second guard side (212S) having at least one second left guard side fastening member (212LSA) and at least one second right guard side fastening member (212RSA) attached thereon. The second Retrofitable fan shroud (210) comprises a second guard front (212F). A second guard slot (212A) is positioned in the second guard side (212S) and the second guard front (212F) terminating centrally therein. The second guard side (212S) and the second guard front (212F) are manufactured from a configuration selected from a group consisting of grid, screen and perforated.

The second retrofitable fan shroud (210) may optionally further comprise a second guard center (212C) positioned centrally in the second guard front (212F) at the termination of the second guard slot (212A). The second guard center (212C) functions to permit user access to the fan (18).

The second retrofitable fan shroud (210) further comprises at least one second fastener (214) connecting the at least one second left guard side fastening member (212LSA) to a left side of the fan housing (16). At least one second fastener (214) connects the at least one second right guard side fastening member (212RSA) to a right side of the fan housing (16).

The second retrofitable fan shroud (210) is constructed from a material selected from a group consisting of plastic, plastic composite, metal, metal alloy, fiberglass, epoxy, carbon-graphite, and wood.

It will be understood that each of the elements described above, or two or more together, may also find an useful application in other types of constructions differing from the type described above.

While the invention has been illustrated and described as embodied in a fan shroud, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. A retrofittable fan shroud for limiting access by an animal to a shaft mounted automotive fan, for mounting to the fan housing of a vehicle, said shroud comprising:

a.) a unitary essentially circular screen housing for positioning over said automotive fan, said housing comprising a first face and a turned peripheral edge of a discrete circumferential dimension, and an open radial portion extending from the center of said first face to said peripheral edge, where said open radial portion is defined by a uniform radially extending slot and a generally circular center opening having a diameter greater than said slot, whereby said housing may be positioned over said automotive fan via said open radial portion; and b.) plural fastening members secured about said peripheral edge for mounting the unitary housing to said fan housing.

* * * * *